US008087266B2

(12) United States Patent
Cho

(10) Patent No.: US 8,087,266 B2
(45) Date of Patent: Jan. 3, 2012

(54) LAUNDRY MACHINE

(75) Inventor: Hung Myong Cho, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 946 days.

(21) Appl. No.: 11/629,663

(22) PCT Filed: Apr. 18, 2006

(86) PCT No.: PCT/KR2006/001425

§ 371 (c)(1),
(2), (4) Date: Mar. 7, 2008

(87) PCT Pub. No.: WO2006/129915

PCT Pub. Date: Dec. 7, 2006

(65) Prior Publication Data

US 2009/0013478 A1 Jan. 15, 2009

(30) Foreign Application Priority Data

May 31, 2005 (KR) ..... 10-2005-0046039
May 31, 2005 (KR) ..... 10-2005-0046041

(51) Int. Cl.
*D06F 39/04* (2006.01)

(52) U.S. Cl. ..... 68/15; 68/207

(58) Field of Classification Search ..... 68/5 R, 68/5 C, 15, 207

See application file for complete search history.

(56) References Cited

U.S. PATENT DOCUMENTS

| | | | |
|---|---|---|---|
| 2,562,843 | A | 7/1951 | Theodor |
| 4,207,683 | A | 6/1980 | Horton |
| 4,484,399 | A | 11/1984 | Biancalani |
| 4,612,090 | A | 9/1986 | Ellis, Jr. |
| 5,315,727 | A | 5/1994 | Lee |
| 2004/0004299 | A1 | 1/2004 | Glucksman |
| 2004/0107509 | A1 | 6/2004 | Kim et al. |
| 2004/0187527 | A1 | 9/2004 | Kim et al. |
| 2004/0187529 | A1 | 9/2004 | Kim et al. |
| 2005/0034250 | A1 | 2/2005 | Oh et al. |

FOREIGN PATENT DOCUMENTS

| | | | |
|---|---|---|---|
| CN | 1534129 | | 10/2004 |
| DE | 577 336 | | 5/1933 |
| DE | 604 415 | | 10/1934 |
| DE | 100 28 944 | | 12/2001 |
| EP | 0 152 745 | | 8/1985 |
| EP | 1 275 767 | | 1/2003 |
| EP | 1 441 059 | | 7/2004 |
| EP | 1 441 060 | | 7/2004 |
| EP | 1 464 750 | | 10/2004 |
| EP | 1 469 120 | | 10/2004 |
| EP | 1 507 031 | A1 | 2/2005 |
| EP | 1 507 032 | A1 | 2/2005 |
| GB | 799788 | | 8/1958 |
| GB | 2 021 953 | | 12/1979 |
| JP | 61-128995 | | 6/1986 |
| JP | 2-239894 | A | 9/1990 |
| JP | 6-233898 | | 8/1994 |

(Continued)

*Primary Examiner* — Joseph L Perrin
(74) *Attorney, Agent, or Firm* — McKenna Long & Aldridge LLP

(57) ABSTRACT

A novel-structure laundry machine that is capable of washing laundry using steam is disclosed. The laundry machine includes a machine body constituting the external appearance thereof, a drum mounted in the machine body for receiving laundry, a steam generation unit for generating steam, and a primary steam supply part for supplying the steam generated in the steam generation unit into the lower part of the drum.

16 Claims, 9 Drawing Sheets

FOREIGN PATENT DOCUMENTS

| | | | |
|---|---|---|---|
| KR | 10-1996-0011358 | | 4/1996 |
| KR | 10-0128631 | | 2/1997 |
| KR | 10-1997-0070295 | A | 11/1997 |
| KR | 10-0172877 | B1 | 10/1998 |
| KR | 10-2003-0012145 | | 2/2003 |
| KR | 10-2004-0088884 | A | 10/2004 |
| KR | 10-2005-0015758 | A | 2/2005 |
| KR | 10-2005-0017489 | A | 2/2005 |
| KR | 10-2005-0017490 | A | 2/2005 |
| KR | 10-2005-0018182 | | 2/2005 |
| KR | 10-2005-0042127 | A | 5/2005 |
| KR | 10-2005-0044884 | | 5/2005 |
| KR | 10-2005-0045968 | A | 5/2005 |
| KR | 10-2005-0065721 | | 6/2005 |
| KR | 10-2005-0093260 | | 9/2005 |
| KR | 10-2006-0023017 | | 3/2006 |
| WO | WO 2004/059070 | | 7/2004 |

LAUNDRY MACHINE

This application claims priority from PCT Application No. PCT/KR2006/001425, filed Apr. 18, 2006, Korean Application 10-2005-0046039, filed May 31, 2005 and Korean Application 10-2005-0046041, filed May 31, 2005, both of which are hereby incorporated by reference in their entirety.

TECHNICAL FIELD

The present invention relates to a laundry machine, and more particularly, to a novel-structure laundry machine that is capable of washing laundry using steam.

BACKGROUND ART

Generally, laundry machines are classified into a vertical type laundry machine, a drum of which is mounted in a vertical direction, and a horizontal type laundry machine, the drum of which is mounted in a horizontal direction. A typical example of the vertical type laundry machine is a pulsator type washing machine, and a typical example of the horizontal type laundry machine is a drum type washing machine.

However, laundry machines do not merely refer to machines that are capable of washing laundry but may include a drying machine that is capable of drying the laundry.

In the drum type washing machine, as the drum is mounted in the horizontal direction as described above, laundry received in the drum is washed by a lifting and dropping operation.

FIGS. 1 and 2 schematically illustrate the structure of a conventional drum type washing machine.

As shown in the drawings, the drum type washing machine includes a machine body 10, a tub 20 mounted in the machine body 10, a drum 30 rotatably mounted in the tub 20, and a driving unit for driving the drum 30.

At the front part of the machine body 10 is formed a laundry inlet hole 11, through which laundry is put into the drum. A door 40 is mounted to the machine body adjacent to the laundry inlet hole 11 for opening and closing the laundry inlet hole.

At opposite sides of the bottom of the outer circumference of the tub 20 are mounted dampers 21, which support the tub 20 in the machine body 10.

In the lower part of the tub 20 is mounted a washing water heater 60 for heating washing water, by which the temperature of the washing water used to wash laundry can be controlled.

The drum 30 is rotatably mounted in the tub 20. At the circumference of the drum 30 are formed a plurality of through-holes 31, through which washing water is introduced into or discharged from the drum.

The driving unit includes a driving motor 71 for driving the drum 30, and a belt 72 for transmitting the driving force of the driving motor 71 to the drum 30.

In the conventional drum type washing machine with the above-stated construction, a washing operation, a rinsing operation, and a spin-drying operation is automatically carried out for a predetermined period of time according to a control signal from a controller (not shown) while laundry and a predetermined amount of detergent are received in the drum 30, whereby the laundry is washed.

In the above-described conventional drum type washing machine, however, the amount of washing water used to wash the laundry is excessive. As a result, a large amount of washing water and power is unnecessarily consumed.

Specifically, in the conventional drum type washing machine, contaminants are not separated from the laundry unless the laundry is submerged in the washing water for a long period of time. For this reason, a large amount of washing water is needed.

Furthermore, in the conventional drum type washing machine, the washing water supplied into the tub is heated by the washing water heater, and then a laundry sterilizing process is carried out using the heated washing water. As a result, the power consumption is also unnecessarily large.

In recent years, there has been proposed a drum type washing machine having an additional steam supply unit mounted therein for supplying high-temperature steam into the drum, whereby the sterilization of the laundry is accomplished only using a small amount of washing water.

The above-described conventional steam supply unit is constructed such that the steam can be injected into the drum from the top side of the drum.

However, in consideration of the fact that the steam is in a high-temperature state, whereby high-temperature steam moves from the bottom part to the upper part of the drum, and laundry is placed at the bottom part of the drum due to gravity, it is difficult to supply the steam to the laundry placed at the bottom part of the drum through the use of the structure in which the steam is injected from the upper part of the drum.

As a result, when the amount of the injected steam is not sufficiently large or when the injection pressure of the steam is not sufficiently high, the steam cannot be smoothly supplied to the laundry placed at the bottom of the drum. Consequently, the washing efficiency using the steam is significantly lowered.

On the other hand, a drying machine having the steam supply unit is also embodied in addition to the washing machine having the steam supply unit. This drying machine not only dries laundry but also supplies the steam to wrinkled dry laundry, thereby accomplishing sterilization of the laundry and removal of wrinkles from the laundry.

Consequently, this drying machine also has the same problems as the above-described problems.

DISCLOSURE OF INVENTION

Therefore, the present invention has been made in view of the above problems, and it is an object of the present invention to provide a novel-structure laundry machine in which steam generated in a steam supply unit is smoothly supplied to laundry placed at the bottom of a drum.

It is another object of the present invention to provide a novel-structure laundry machine in which spray-state washing water as well as the steam is injected into the drum when the laundry is wetted and/or when the washing operation is carried out, whereby the wetting process of the laundry and the corresponding washing operation are more smoothly carried out.

Additional advantages, objects, and features of the present invention will be set forth in part in the following description of preferred embodiments.

The object of the present invention can be achieved by providing a laundry machine comprising: a machine body constituting the external appearance thereof; a drum mounted in the machine body for receiving laundry; a steam generation unit for generating steam; and a primary steam supply part for supplying the steam generated in the steam generation unit into the lower part of the drum.

The laundry machine may further comprise: a water supply unit for supplying water for steam generation to the steam generation unit; and a water supply control unit for controlling the supply of water for steam generation.

Of course, the laundry machine may further comprise: a tub for storing washing water, the tub having the drum rotatably mounted therein. In this case, it is preferable that the water supply unit supply washing water to the tub, and the water supply control unit control the supply of the washing water.

Preferably, the primary steam supply part communicates with the interior of the tub through a predetermined position of the lower circumference of the tub. The tub may be provided at the lower part thereof with a storage part, which protrudes downward, and the storage part may have a heater for heating the washing water mounted therein.

Preferably, the predetermined position of the tub through which the primary steam supply part extends is lower than the bottom of the drum but is higher than the position where the heater is mounted. This is because the steam supplied from the primary steam supply part may interfere with the lower part of the drum and the heater.

Preferably, the steam generation unit includes: a case for storing the water for steam generation therein, the case being located lower than the middle part of the machine body in the machine body; and a heater for heating the water for steam generation.

Preferably, the case is located substantially at a position lower than the bottom of the drum, and the laundry machine further comprises: a water level detection part for detecting the water level of water received in the case.

Preferably, the water supply unit includes: a first water supply pipe for supplying washing water to the tub; and a second water supply pipe for supplying water for steam generation to the case, and the water supply control unit includes water supply valves mounted on the first water supply pipe and the second water supply pipe, respectively.

Preferably, the water supply valves and the heater are controlled based on the water level detected by the water level detection part.

The water level detection part may include an electrode sensor having at least two electrodes.

On the other hand, the laundry machine may further comprise: an auxiliary steam supply part for supplying the steam generated in the steam generation unit to the upper side of the drum.

Preferably, the auxiliary steam supply part is an auxiliary steam supply pipe diverging from the primary steam supply part. The laundry machine further comprises: a flow direction control valve mounted at the region where the auxiliary steam supply part diverges from the primary steam supply part for selectively opening and closing the respective pipe lines or controlling the opening degree of the respective pipe lines.

Also, the laundry machine may further comprise: a washing water circulation unit for circulating the washing water received in the tub such that the washing water can be supplied into the drum.

Preferably, the washing water circulation unit includes: an inlet pipe for receiving the washing water from the tub; a circulating pump mounted on the pipe line of the inlet pipe for pumping the washing water; and a guide pipe for supplying the washing water pumped by the circulating pump into the drum.

Preferably, the laundry machine further comprises: injection nozzles disposed at the end of the auxiliary steam supply pipe and the end of the guide pipe for injecting the steam and the washing water, respectively, the injection nozzles extending through the gasket such that the injection nozzles can communicate with the upper side of the drum.

In another aspect of the present invention, provided herein is a control method of a laundry machine, comprising the steps of: (a) supplying water for steam generation; (b) generating steam; (c) supplying the generated steam to the lower side of a tub.

Preferably, steps (a) and (b) are controlled depending upon the water level of the water supplied for the steam generation, and the control method further comprising the steps of: (d) supplying washing water to the tub at least prior to step (c).

Also, the control method may further comprise the steps of: (e) circulating the supplied washing water and injecting the circulated washing water into the drum in the course of carrying out step (c). Preferably, the control method further comprises the steps of: rotating the drum in the course of carrying out step (c) or step (e).

In yet another aspect of the present invention, provided herein is a control method of a laundry machine, comprising the steps of: (a) checking whether the current operation is an operation requiring the supply of steam; (b) when the current operation is the operation requiring the supply of steam, checking the water level of water for steam generation; (c) when the checked water level is lower than a predetermined water level, controlling a water supply valve such that the water for steam generation can be supplied until the water level reaches the predetermined water level, and, when the checked water level is higher than the predetermined water level, controlling a heater to generate steam; and (d) supplying the generated steam to the lower side of the tub.

The control method may further comprise the steps of: (d) selectively supplying the generated steam to the upper side of the drum. Preferably, step (e) is carried out according to the user's selection as needed.

According to the present invention as described above, the steam generated in the steam supply unit can be supplied into the lower side of the drum, and therefore, the steam can be smoothly supplied to the laundry placed at the bottom of the drum. Consequently, the washing efficiency using the steam is maximized.

Especially, the steam can be supplied to the laundry while the steam flows upward, whereby the washing efficiency is further increased.

Furthermore, the spray-state washing water as well as the steam can be injected into the drum when the laundry is wetted and/or when the washing operation is carried out, whereby the wetting process of the laundry and the corresponding washing operation are more smoothly carried out.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in FIGS. 3 to 6.

Figure 1:
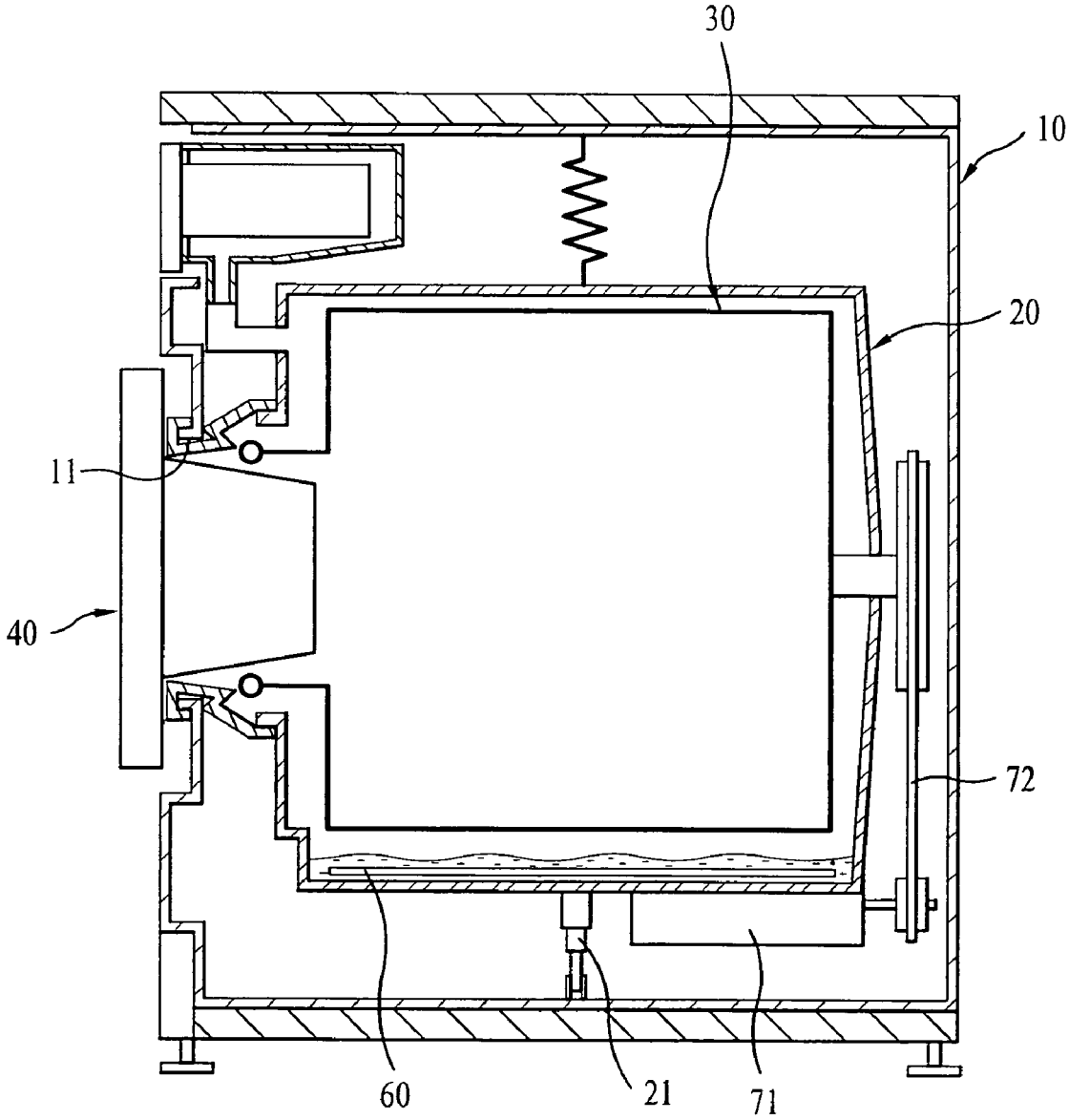
FIG. 1 is a side view, in section, illustrating the interior structure of a conventional drum type washing machine.
Figure 2:
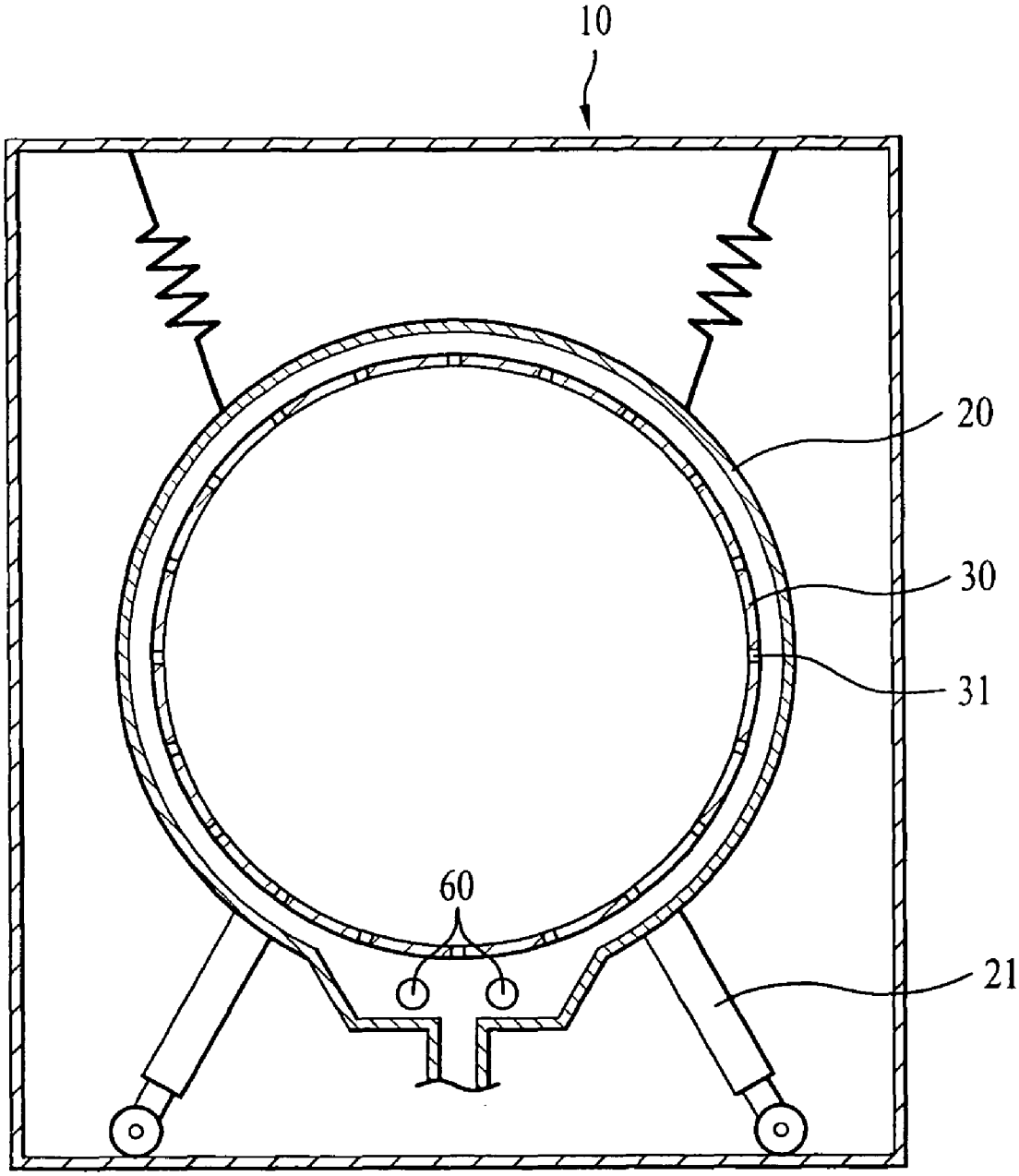
FIG. 2 is a front view, in section, illustrating the interior structure of the conventional drum type washing machine.
Figure 3:
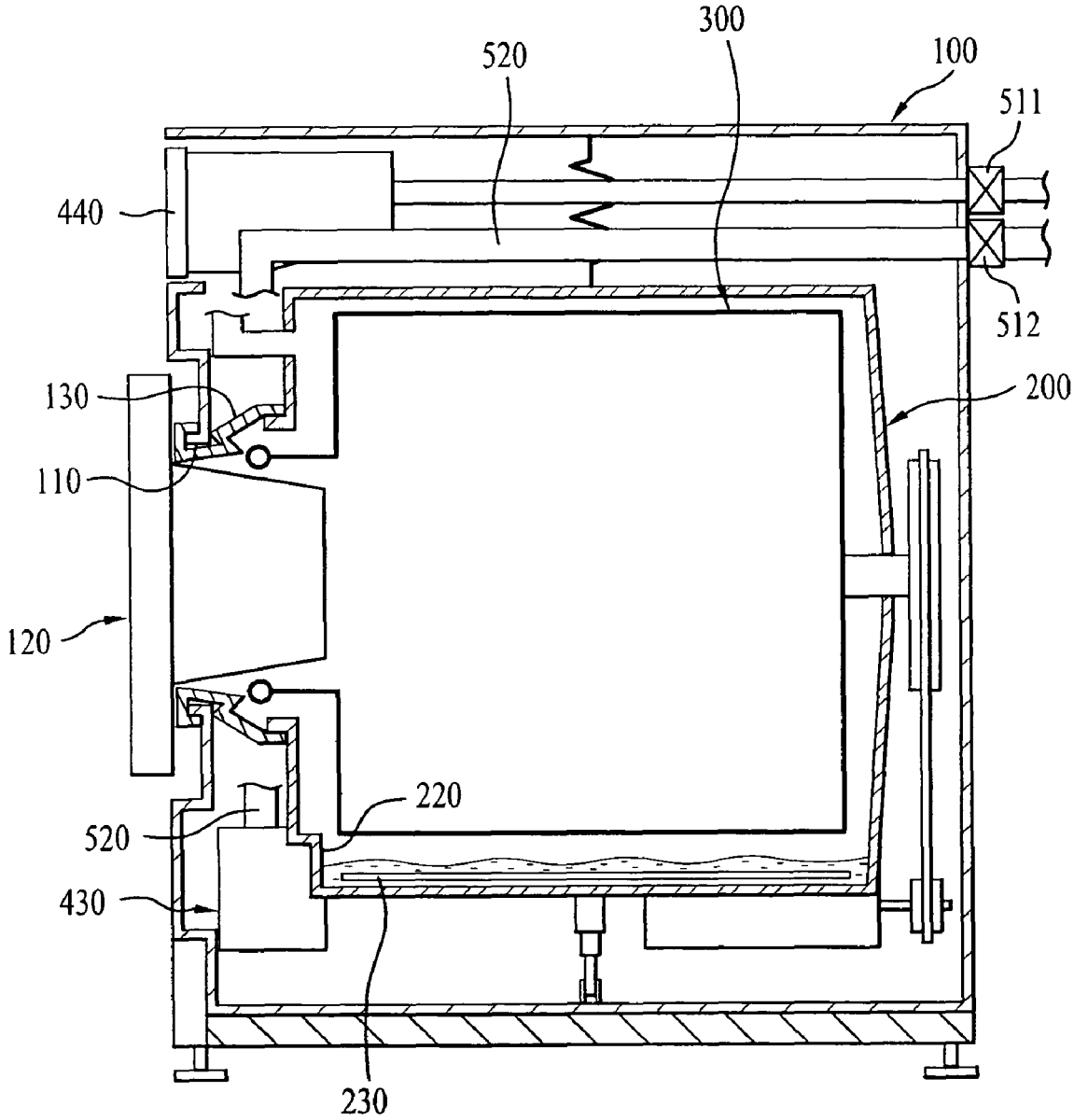
FIG. 3 is a side view, in section, illustrating the interior structure of a laundry machine according to a first preferred embodiment of the present invention.
Figure 4:
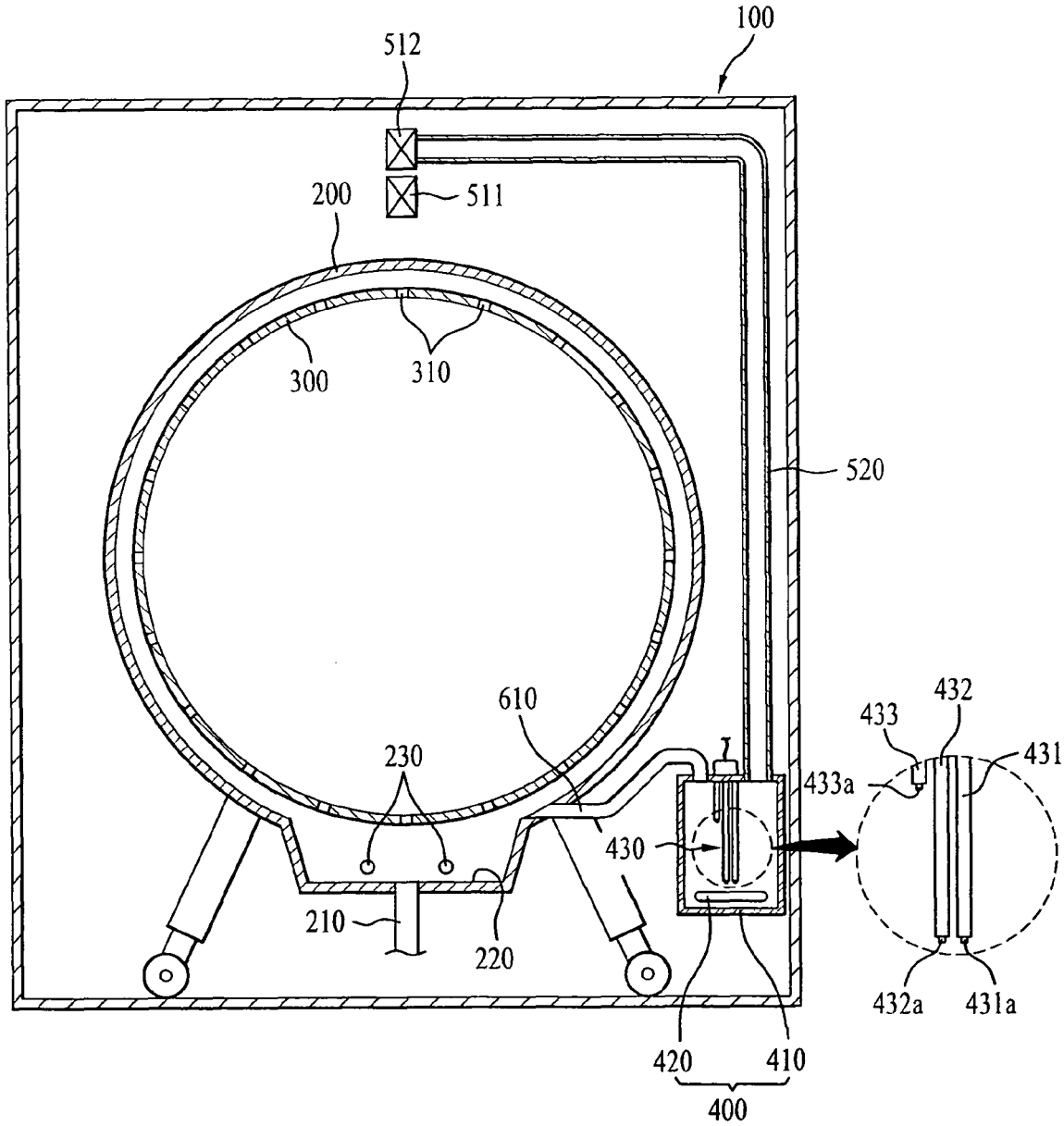
FIG. 4 is a front view, in section, illustrating the interior structure of the laundry machine according to the first preferred embodiment of the present invention.

First, FIGS. 3 and 4 illustrate a laundry machine according to a first preferred embodiment of the present invention.

Specifically, the laundry machine according to the first preferred embodiment of the present invention includes a machine body 100, a tub 200, a drum 300, a steam supply unit 400, a primary steam supply pipe 610, water supply valves 511 and 512, a water supply pipe 520, and a control unit. In this embodiment, the laundry machine is a drum type washing machine. In the case that the laundry machine is a drying machine, the tub, in which washing water is received, is not necessarily provided for the drying machine.

The machine body 100 constitutes the external appearance of the laundry machine. At the front part of the machine body 100 is formed a laundry inlet hole 110. The tub 200 is mounted in the machine body 100 in a supported state.

A door 120 is mounted to the machine body 100 adjacent to the laundry inlet hole 110 for opening and closing the laundry inlet hole 110.

To the lower part of the tub 200 is connected a water drainage pipe 210, through which washing water (or cleansing water) is drained.

At the lower part of the tub 200, to which the water drainage pipe 210 is connected, is formed a storage part 220, which protrudes downward. In the storage part 220 is mounted a heater 230.

Preferably, a temperature sensor (not shown) is further located in the space where the heater 230 is located because the temperature of the washing water heated by the heater 230 can be accurately detected by the temperature sensor.

The drum 300 is rotatably mounted in the tub 200, and is disposed such that the open side of the drum 300 is directed to the laundry inlet hole 110 of the machine body 100.

At the circumference of the drum 300 are formed a plurality of through-holes 310, through which washing water and steam supplied into the tub 200 are introduced into the drum 300.

Between the laundry inlet hole 110 of the machine body 100 and the front end of the drum 300 is mounted a gasket 130, by which the space defined between the laundry inlet hole 110 of the machine body 100 and the front end of the drum 300 is partitioned from the inner space of the machine body 100.

The steam supply unit 400 is mounted in the machine body 100 for generating a predetermined amount of steam.

The steam supply unit 400 is constructed to evaporate water using high-temperature heat. The steam supply unit 400 includes a case 410 and a heater 420.

The case 410 is located approximately at the same height as or lower than the middle part of the machine body 100 in the machine body 100.

This structure is provided in consideration of the fact that the discharge pressure of upward-flowing high-temperature steam is greater than the discharge pressure of downward-flowing high-temperature steam. This is because steam is generally lighter than air.

Specifically, the case 410, in which the steam is substantially generated, is located at a predetermined position approximately below the middle part of the machine body 100 in the machine body 100 such that the steam generated in the case 410 can be discharged while the steam flows upward, whereby the discharge of the steam is more smoothly performed.

Preferably, the case 410 is located approximately at the same height as or lower than the bottom of the drum 300 in the machine body 100.

This structure is provided in consideration of the fact that the distance between the opposite sides of the machine body 100 and the tub 200 is very small, and therefore, it is very difficult to mount the case to the corresponding area.

Of course, it is possible to locate the steam supply unit 400 at the lowermost height of the machine body such that the steam generated in the steam supply unit 400 can be more smoothly injected.

Also, the heater 420 is constructed to heat the water stored in the case 410 such that the water is evaporated into steam. The heater 420 is disposed in the case 410.

It is preferable that the above-described steam supply unit 400 be further provided with a water level detection part 430 for detecting the water level of water stored in the case 410.

The water level detection part 430 is constructed using at least one of an electrode sensor for detecting the current water level using at least two electrodes, a temperature sensor for detecting the current water level based on the change of temperature difference, a weight sensor for detecting the current water level based on the change of weight, and a pressure sensor for detecting the current water level based on the change of pressure.

In the first preferred embodiment of the present invention, the water level detection part 430 is constructed using the electrode sensor.

The water level detection part 430 includes a common electrode 431 located at a predetermined position in the case 410, a low water level detecting electrode 432, and a high water level detecting electrode 433. Of course, the water level detection part 430 may include three or more electrodes.

The low water level detecting electrode 432 has an exposed terminal 432*a*, which is located at the same height as the exposed terminal 431*a* of the common electrode 431. The high water level detecting electrode 433 has an exposed terminal 433*a*, which is located higher than the exposed terminal 431*a* of the common electrode 431 and the exposed terminal 432*a* of the low water level detecting electrode 432.

The primary steam supply part 160 supplies the steam generated in the steam supply unit 400 into the drum. In this case, it is preferable that the primary steam supply part be a primary steam supply pipe 610 constructed in the shape of a pipe.

The primary steam supply part may directly supply the steam into the drum. Alternatively, the primary steam supply part may supply the steam into the drum through the tub.

Preferably, one end of the primary steam supply pipe 610 is connected to the upper end or the upper surface of the case 410 of the steam supply unit 400, and the other end of the primary steam supply pipe 610 is connected to the tub 200 such that the other end of the primary steam supply pipe 610 extends through the lower circumference of the tub 200, which is lower than the bottom of the drum 300, and communicates with the interior of the tub 200.

Especially, it is most preferable that the other end of the primary steam supply pipe 610 is located lower than the bottom of the drum 300 at the lower circumference of the tub 200 but is located higher than the heater 230 disposed in the storage part 220.

This structure provides an advantage in that the steam can uniformly flow to the whole area in the drum 300. Also, it is possible to prevent interference the supplied steam with the lower part of the drum and the heater by the provision of this structure.

Here, in consideration of the fact that the steam is in a high-temperature state, and high-temperature steam flows to relatively high positions, when the steam is supplied into the drum 300 from the bottom of the tub 200, the steam can be uniformly supplied to the upper space of the drum 300 as well as the bottom part of the drum 300.

This structure solves the problem of the conventional art that the steam supplied from the top part of the drum 300 cannot be uniformly supplied to the bottom of the drum 300.

Especially, in consideration of the fact that laundry is placed at the bottom of the drum 300, the washing efficiency is further increased by the steam supplied from the bottom of the drum 300.

The water supply valves 511 and 512 are operated such that the washing water and the water for steam generation can be selectively supplied. The water supply valves 511 and 512 are mounted in the upper space at the rear part of the machine body 100.

It is preferable to provide two or more water supply valves 511 and 512. One of the water supply valves, i.e., the water supply valve 511 (hereinafter, referred to as a "first water supply valve"), is used to supply the washing water into the tub 200, and the other water supply valve 512 (hereinafter, referred to as a "second water supply valve"), is used to supply the water for steam generation into the case 410 of the steam supply unit 400.

Of course, only one water supply valve to selectively supply the water for steam generation is necessary for a drying machine.

Preferably, the respective water supply valves 511 and 512 are constructed using solenoid valves, which can be electrically controlled. More specifically, the water supply valves 511 and 512 may be solenoid valves the opening degree of which is adjustable.

The water supply pipe 520 serves to transmit water for steam generation, which is supplied from the outside, to the case 410 of the steam supply unit 400.

One end of the water supply pipe 520 is connected to the case 410 such that the water supply pipe 520 communicates with the case 410, and the other end of the water supply pipe 520 is connected to the second water supply valve 512.

The control unit (not shown) is provided to control the selective operation of the respective water supply valves 511 and 512 and the selective heat emission of the heater 420.

In this case, the control unit is constructed such that the control unit continuously checks whether electrical conduction between the common electrode 431 and the other electrodes 432 and 433 of the water level detection part 430 has been accomplished so as to recognize the current water level, and controls the operations of the second water supply valve 512 and the heater 420 based on the recognized water level.

Of course, it is most preferable that the control unit also control the selective driving of the drum 300 and the operations of other components.

Figure 5:
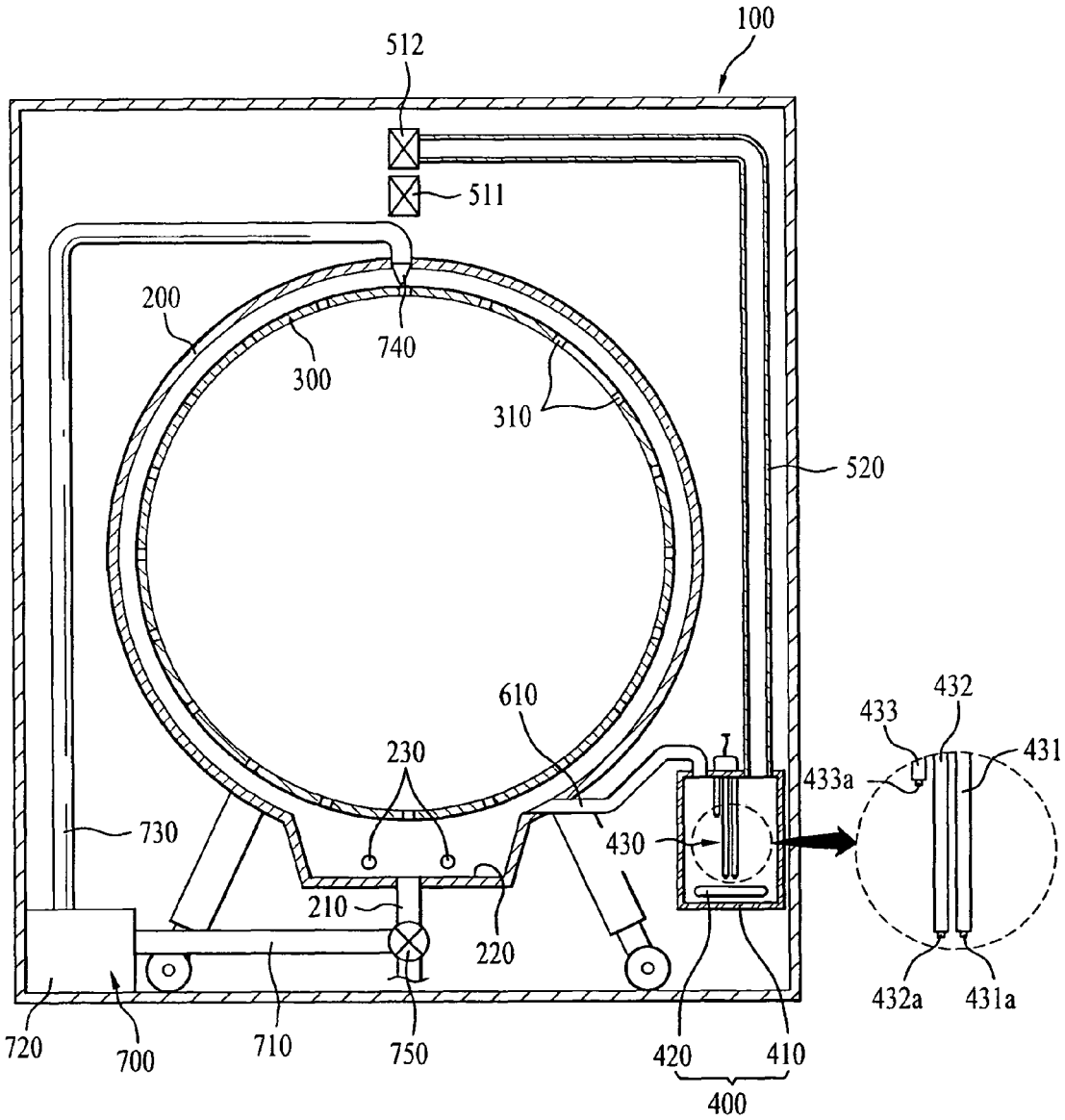
FIG. 5 is a front view, in section, illustrating the interior structure of a modified example of the laundry machine according to the first preferred embodiment of the present invention.
Figure 6:
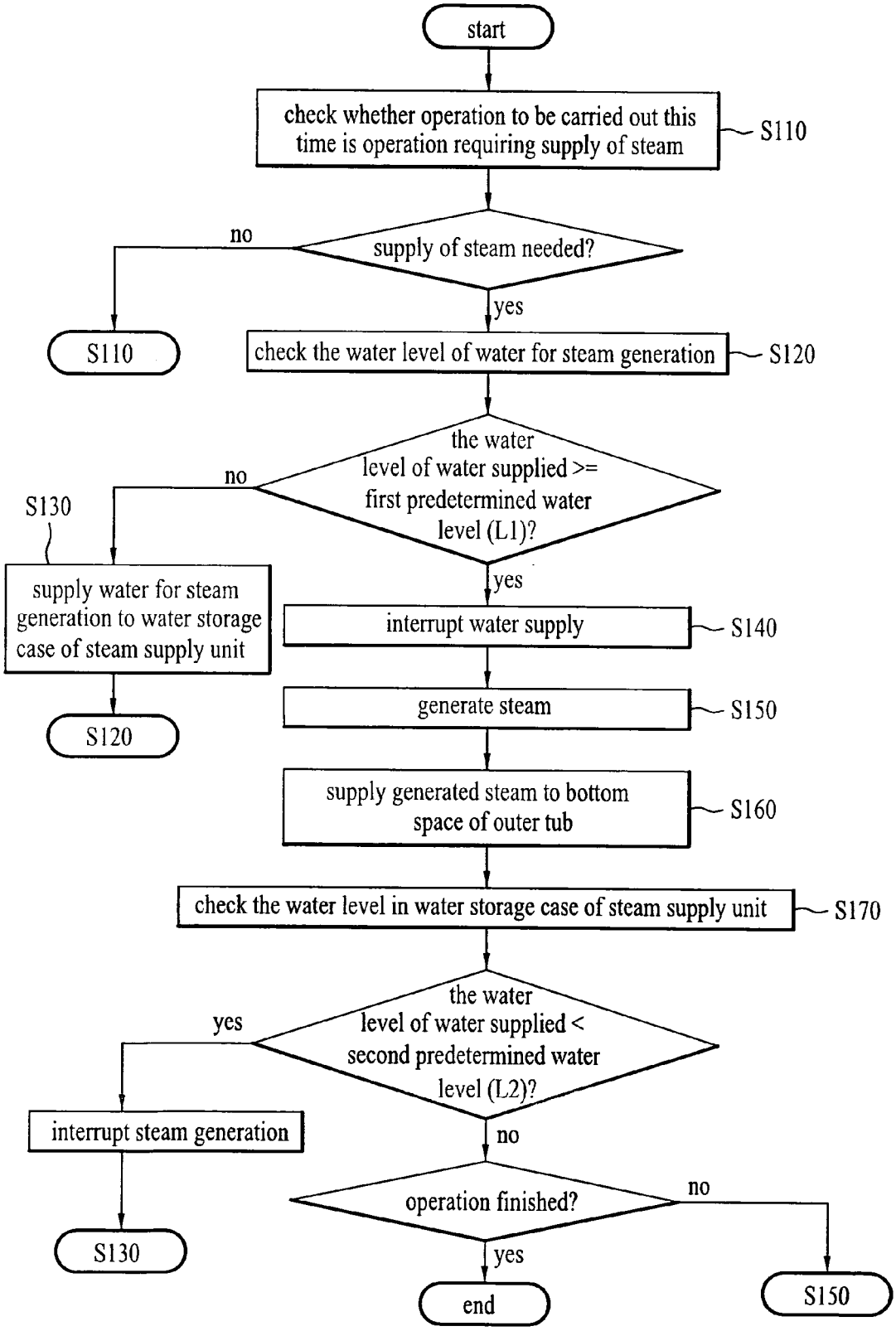
FIG. 6 is a flow chart schematically illustrating a washing method according to a first preferred embodiment of the present invention.

As shown in FIG. 5, the laundry machine according to the first preferred embodiment of the present invention further comprises a washing water circulation unit 700 mounted in the machine body 100 for circulating the washing water in the tub 200 such that the washing water can be injected into the drum 300.

The washing water circulation unit 700 is a structure for injecting the washing water into the drum 300 when the laundry is wetted and/or when the washing operation is carried out, whereby the wetting process of the laundry is more smoothly carried out, and therefore, the washing efficiency is improved.

In this case, the washing water circulation unit 700 includes an inlet pipe 710 for receiving the washing water from the tub 200, a circulating pump 720 mounted on the pipe line of the inlet pipe 710 for pumping the washing water, a guide pipe 730 for guiding the washing water pumped by the circulating pump 720 to the upper space of the machine body 100, and an injection nozzle 740 coupled to the discharge side of the guide pipe 730 and extending through a rim part 130, such that the injection nozzle 740 can communicate with the inside upper end of the drum 300, for injecting the pumped washing water.

Preferably, the inlet pipe 701 is connected to the water drainage pipe 210 such that the inlet pipe 701 can communicate with the water drainage pipe 210. Also preferably, an on-off valve 750 is mounted on the pipe line of the inlet pipe 710 or the pipe line of the water drainage pipe 210 for selectively opening and closing the two pipe lines.

Hereinafter, a control method according to a preferred embodiment of the present invention, which is performed using the laundry machine according to the first preferred embodiment of the present invention, will be described in more detail.

The control method according to the preferred embodiment of the present invention includes an operation checking step, a water level checking step, a steam generating step, and a steam supplying step, which are carried out successively. These steps will be described in order below in more detail.

First, when the washing process is progressed, the control part checks whether an operation to be carried out this time is an operation requiring the supply of steam (S110).

At this time, operations using the steam include various operations, such as a laundry wetting operation, a soaking operation, a washing operation, a sterilizing operation, and a post-drying operation.

When the result of the checking reveals that the operation to be carried out this time is the operation requiring the supply of steam, the control unit checks the water level of water for steam generation stored in the water storage case 410 of the steam supply unit 400 through the control of the water level detection part 430 (S120).

At this time, the detection of the water level of the water for steam generation is performed by checking whether electrical conduction between the common electrode 431 and the low water level detecting electrode 432 has been accomplished and/or electrical conduction between the common electrode 431 and the high water level detecting electrode 433 has been accomplished.

When the result of the checking reveals that the electrical conduction between the common electrode 431 and the high water level detecting electrode 433 has not been accomplished, the control part determines that the current water level in the water storage case 410 is lower than the maximum water level L1 necessary for the operation (hereinafter, referred to as a "first predetermined water level").

The first predetermined water level is previously set in the control unit. The first predetermined water level is a full water level.

Consequently, in this case, the control unit controls the operation of one of the water supply valves 511 and 512, i.e., the second water supply valve 512 mounted on the second water supply pipe 522, such that water for steam generation can be further supplied.

Specifically, the control unit controls the second water supply valve 512 to open the second water supply pipe 522 such that the water for steam generation can be supplied through the second water supply pipe 522 until the water level reaches the first predetermined water level L1 (S130).

At this time, since the second water supply pipe 522 is connected to the water storage case 410, the water for steam generation supplied along the second water supply pipe 522 is stored in the water storage case 410. As a result, the water level in the water storage case 410 is gradually increased.

Even while the above-described water supply is progressed, the control unit continuously checks whether the electrical conduction between the common electrode 431 and the high water level detecting electrode 433, which constitute the water level detection part 430, has been accomplished.

In this course, when the electrical conduction between the common electrode 431 and the high water level detecting electrode 433 has been accomplished (the water level of the water supplied has reached the first predetermined water level), the control unit controls the operation of the second water supply valve 512 such that the water supply is interrupted (S140).

Accomplishment of the electrical conduction between the common electrode 431 and the high water level detecting electrode 433 means that the water level in the water storage case 410 is the full water level.

When the water level in the water storage case 410 reaches the first predetermined water level (L1), i.e., the full water level, through the above-described process, the control unit controls the heater 420 to generate steam (S150).

The generated steam is supplied to the bottom space of the tub 200 through the primary steam supply pipe 610 connected to the water storage case 410.

Subsequently, the steam passes through the respective through-holes 310, and then flows upward from the bottom of the drum 300. In this course, the steam is supplied to the laundry placed at the bottom of the drum 300 such that the laundry can be washed or sterilized.

Of course, it is preferable to control the drum 300 to be continuously rotated (in one direction or in alternating directions) during the supply of steam as described above.

While the steam is generated as described above, and the corresponding operation using the generated steam is progressed, the control unit checks whether the water level in the water storage case is lower than the minimum water level L2 necessary for the operation (hereinafter, referred to as a "second predetermined water level") (S170).

This is performed by continuously checking whether the electrical conduction between the common electrode 431 and the low water level detecting electrode 432, which constitute the water level detection part 430, has been accomplished.

When the common electrode 431 and the low water level detecting electrode 432 are electrically disconnected from each other, in the course of checking whether the electric conduction between the respective electrodes 431 and 432 of the water level detection part 430, the control unit controls the operation of the second water supply valve 512 such that further water supply is accomplished.

At this time, the heater 420 constituting the steam supply unit 400 is controlled such that the heat emission from the heater 420 is interrupted.

This control operation is carried out to effectively prevent the occurrence of a fire due to abrupt temperature increase, which may be caused when the heat is continuously emitted from the heater 420 in spite of the shortage of water.

The further supply of water is continuously performed until the electrical conduction between the common electrode 431 and the high water level detecting electrode 433 is accomplished. When the electrical conduction between the two electrodes 431 and 433 has been accomplished, the control unit controls the operation of the second water supply valve 512 such that the water supply is interrupted.

Subsequently, the control unit controls the above-described process, i.e., the steam generation and the corresponding operation using the generated steam, to be continuously progressed.

After the above-described process has been performed for a predetermined period of time, the heat emission from the heater 420 is interrupted, and, at the same time, the rotation of the drum 300. Consequently, the corresponding operation is finished.

While the above-described control process according to the first preferred embodiment of the present invention is progressed, on the other hand, it is preferable that the control method further comprise a process of circulating washing water, as occasion demands, under the control of the control unit.

This washing water circulating process includes a checking step, a washing water supplying step, and a washing water circulating step, which are carried out successively. These steps will be described below in more detail in order.

First, the control part checks whether an operation to be carried out this time is an operation requiring the washing water circulation.

At this time, operations requiring the washing water circulation include various operations, such as a laundry wetting operation, a soaking operation, a washing operation, and a rinsing operation.

When the result of the checking reveals that the operation to be carried out this time is the operation requiring the washing water circulation, the control unit controls the operation of the first water supply valve 511 such that washing water can be supplied to the first water supply pipe 521.

At this time, since the first water supply pipe 521 is connected to the tub 200 such that the first water supply pipe 521 can communicate with the interior of the tub 200, the washing water supplied along the first water supply pipe 521 is stored in the storage part 220, which is the bottom space of the tub 200.

Subsequently, the control unit controls the operation of the circulating pump 720 such that the washing water stored in the storage part 220 of the tub 200 can be circulated.

In this case, the washing water flows successively through the inlet pipe 710, the circulating pump 720, and the guide pipe 730, and is then injected into the drum through the injection nozzle 740 such that the washing water is supplied to the laundry.

Meanwhile, the laundry machine according to the present invention is not limited to the above-described structure.

Specifically, the structure of laundry machine according to the present invention may be changed in various manners, which will be described below in brief.

The above-described first preferred embodiment of the present invention is constructed such that the steam is supplied only into the bottom space of the drum 300 through the bottom of the tub 200.

Consequently, the amount of the steam actually supplied to the upper space of the drum 300 is remarkably small due to the laundry placed in the bottom space of the drum 300. As a result, the steam cannot be uniformly supplied to the upper and lower parts of the laundry, and therefore, the washing efficiency is lowered.

Figure 7:
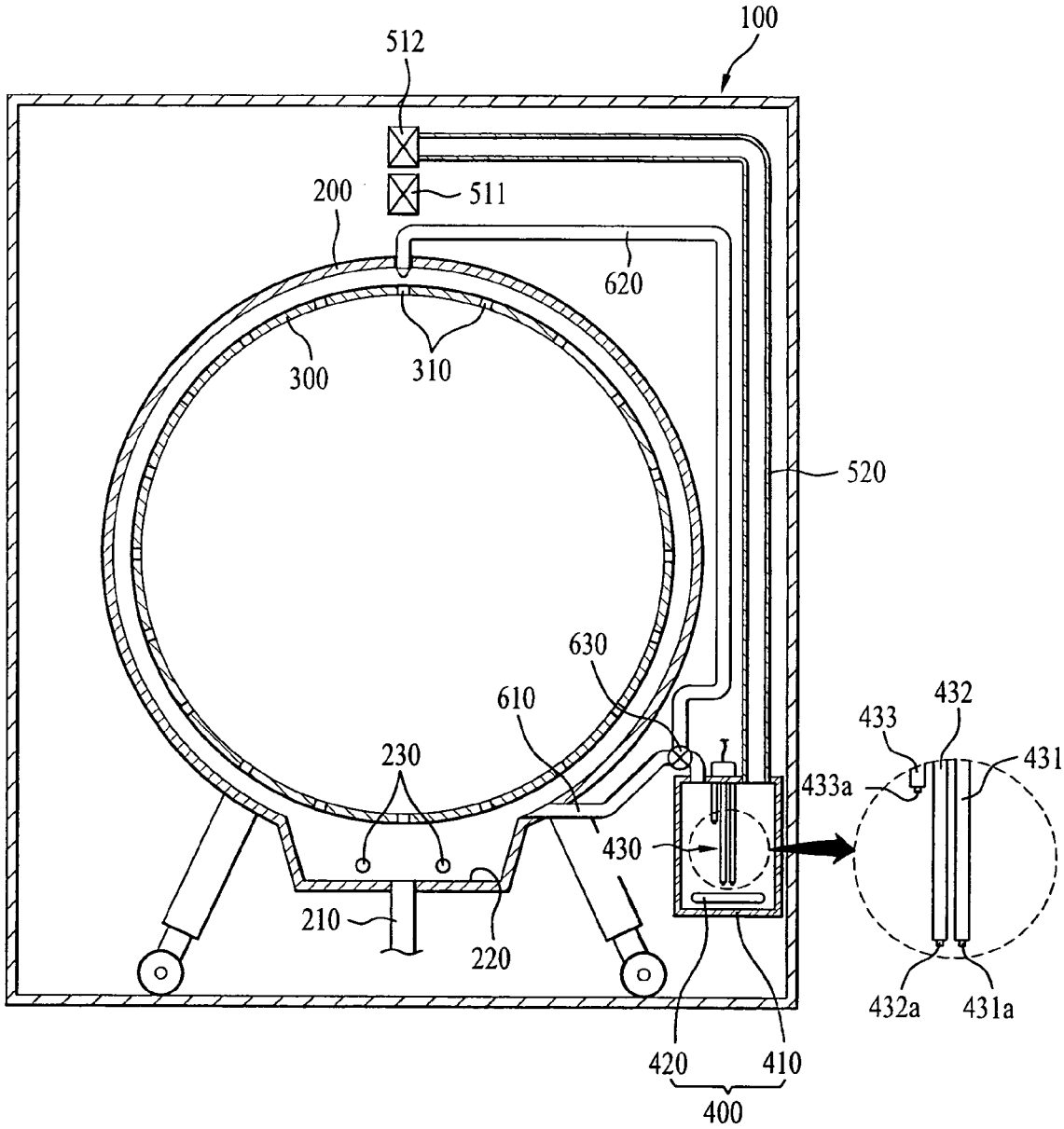
FIGS. 7 and 8 are front views, in section, illustrating the interior structure of a laundry machine according to a second preferred embodiment of the present invention.

To solve the above-mentioned problem, a laundry machine according to a second preferred embodiment of the present invention may further comprise an additional auxiliary steam supply part 620, as shown in FIG. 7.

In this case, the primary steam supply pipe 610, which supplies the steam generated in the steam supply unit 400 into the tub 200, is connected to the tub in such a manner that the steam can be supplied into the drum 300 through the bottom space of the tub 200. The auxiliary steam supply pipe 620 is constructed such that the steam generated in the steam supply unit 400 can be injected toward the bottom-side space of the drum 300 from the top-side space of the drum 300.

Most preferably, the discharge end of the auxiliary steam supply pipe 620 extends through the gasket 130 such that the auxiliary steam supply pipe communicates with the interior of the drum 300.

Especially, it is preferable that the auxiliary steam supply pipe 620 diverge from a predetermined region of the pipe line of the primary steam supply pipe 610. This construction minimizes the pipe line extending from the steam supply unit 400, and therefore, the line distribution is simplified.

In this case, it is preferable that a flow direction control valve 630 for allowing selective supply and/or interruption of the steam to the respective steam supply pipes be further provided at the region where the auxiliary steam supply pipe 620 diverges from the primary steam supply pipe 610. Of course, the flow direction control valve may be a valve the opening degree of which is adjustable.

This is because the steam may be supplied from the bottom part of the drum 300, the steam may be supplied from the top part of the drum 300, or the steam may be supplied simultaneously from the top and bottom parts of the drum 300 according to the corresponding operation.

Consequently, the laundry machine with the above-stated construction according to the preferred embodiment of the present invention has an advantage in that the steam can be supplied simultaneously to the upper space of the drum 300 and the lower space of the drum 300, and therefore, the steam can be uniformly supplied to the upper and lower parts of the laundry, whereby the washing efficiency is improved.

Figure 8:
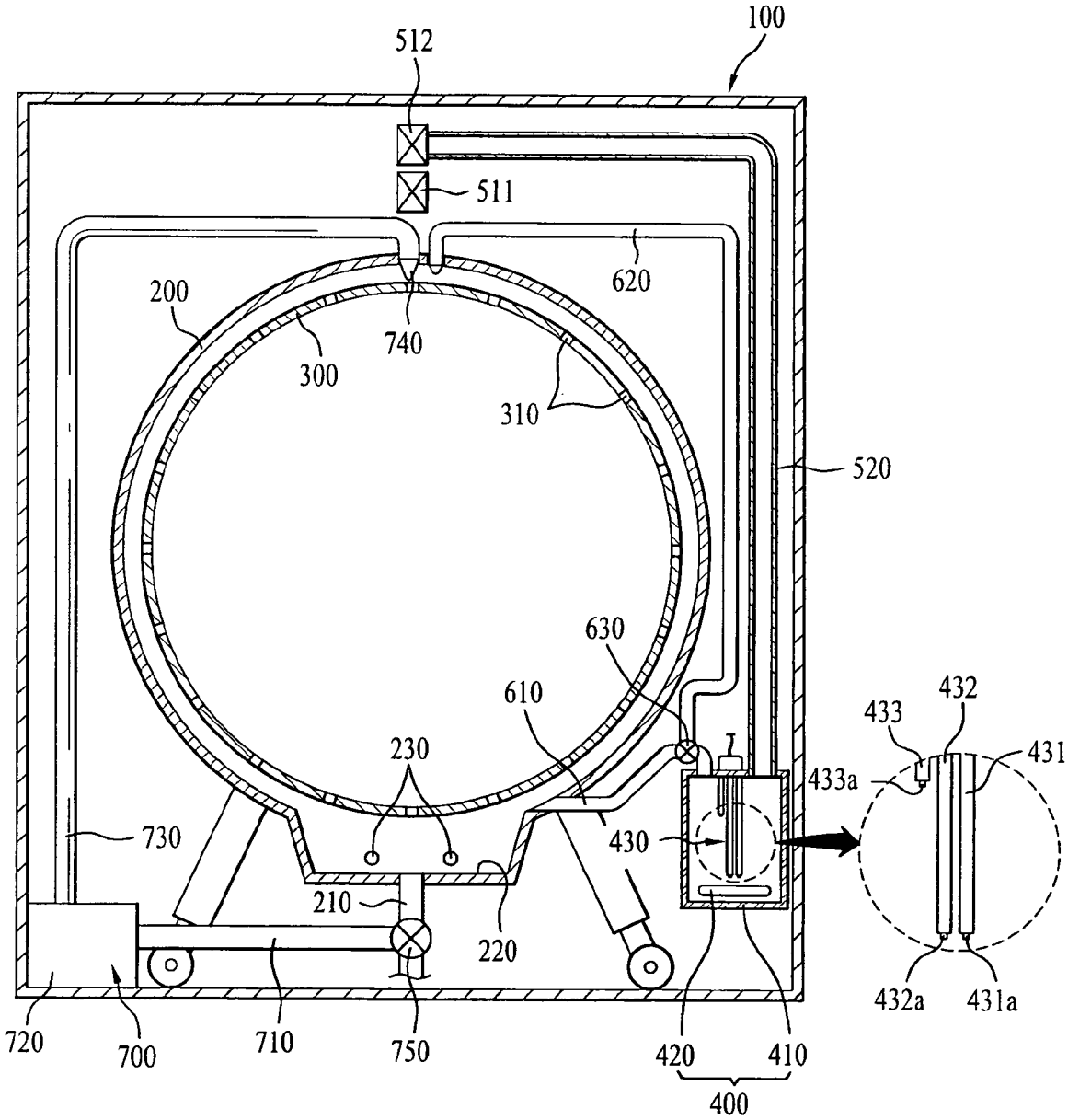

First, FIG. 8 illustrates a laundry machine according to a third preferred embodiment of the present invention.

The laundry machine according to the third preferred embodiment of the present invention may further comprise a washing waster circulation unit 700 and an auxiliary steam supply pipe 620, which have been described above in detail. Accordingly, a detailed description thereof will not be given.

Figure 9:
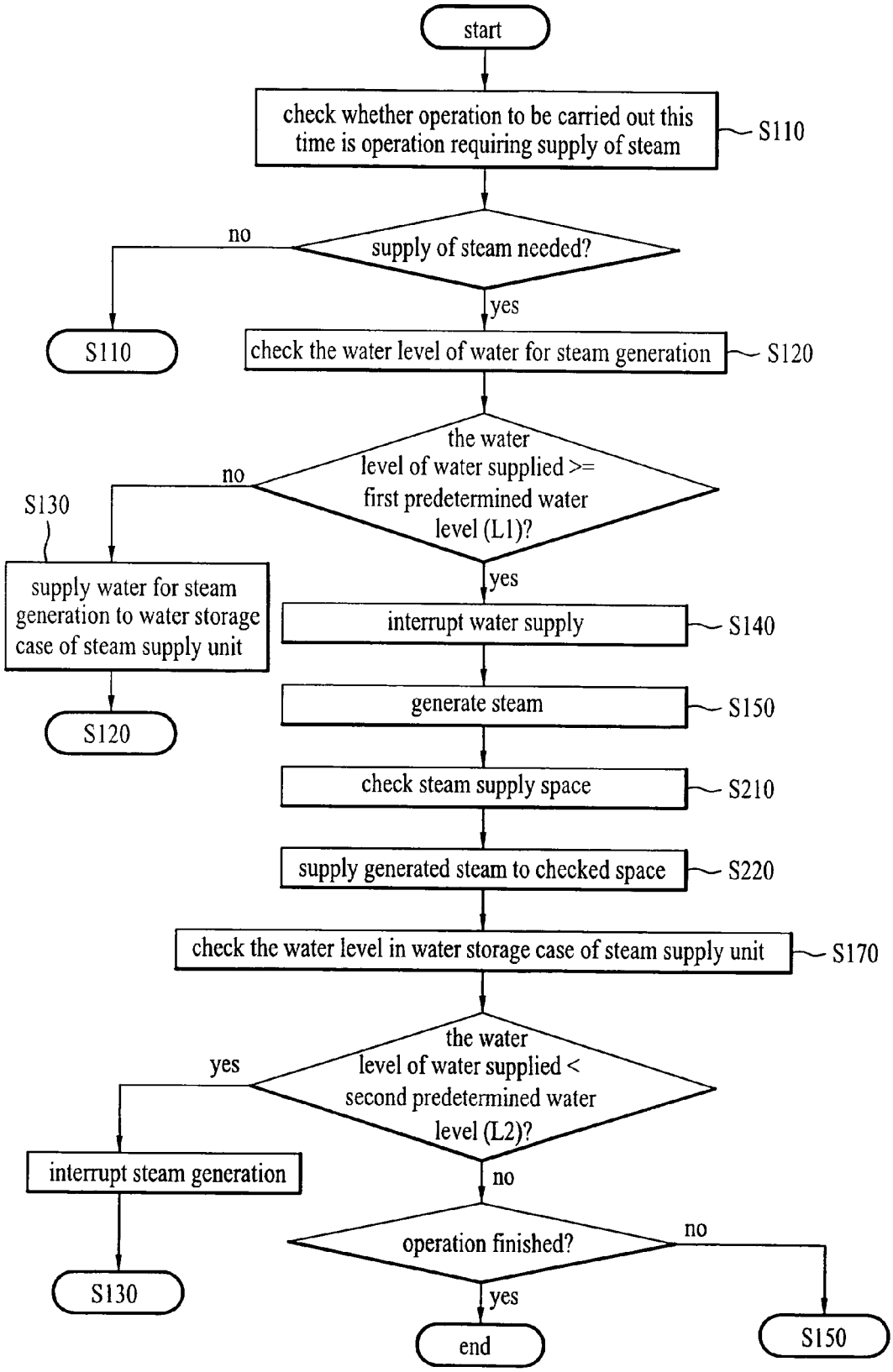
FIG. 9 is a flow chart schematically illustrating a washing method according to a second preferred embodiment of the present invention.

Hereinafter, a control method of the laundry machine according to the third preferred embodiment of the present invention will be described with reference to the flow chart of FIG. 9.

First, a step of checking whether an operation selected by a user is an operation requiring the supply of steam (S110), a step of, when the selected operation is the operation requiring the supply of steam, checking the water level of water for steam generation stored in the water storage case 410 of the steam supply unit 400 (S120), a step of, when the checked water level is lower than a predetermined water level, controlling the second water supply valve 512 such that the water for steam generation can be supplied until the water level reaches the predetermined water level (S130), and a step of controlling the heater 420 to generate steam (S150) are the same as the control method according the above-described first preferred embodiment of the present invention.

However, the control method of the laundry machine according to the third preferred embodiment of the present invention further includes a step of checking a steam supply space before the steam generated through the above-described steps is supplied into the tub 200.

Of course, it is most preferable that the steam be supplied simultaneously from the upper and lower parts of the tub 200, whereby the steam can be uniformly supplied to the whole parts of the laundry.

In the case that the steam is supplied from the upper part of the drum, it is preferable to inject the steam at an appropriate injection pressure such that the steam can be supplied to the lower part of the drum.

According to the third preferred embodiment of the present invention, the steam supply space is set differently based on the operations performed using the steam (for example, the soaking operation, the washing operation, the rinsing operation, the sterilizing operation, the spin-drying operation, the drying operation, etc.) Of course, the steam supply space may be set according to a user's selection.

When the steam supply space is decided as described above, the control unit controls the flow direction control valve based on the decision such that the steam can be supplied only into the decided steam supply space (S220).

After the operation requiring the supply of the steam is completed through the above-described process, a control process is carried out such that the rotation of the drum and the heat emission from the heater are interrupted, and therefore, further supply of steam is not performed. Consequently, the corresponding operation is finished.

As can be understood from the above description, the laundry machine according to the present invention can be modified in various manners.

INDUSTRIAL APPLICABILITY

It is included in the detailed description of the invention.

What is claimed is:

1. A laundry machine comprising:

a machine body;

a drum mounted in the machine body to receive laundry;

a steam generator to generate steam;

a first steam supply part to supply the generated steam to a lower part of the drum;

a second steam supply part to supply the generated steam to the upper side of the drum, the second steam supply part diverging from the first supply part; and a flow direction control valve mounted at a region where the second steam supply diverges from the first steam supply part to selectively open and close the first and second steam supply parts or to control the size of the opening of the first and second steam supply parts.

2. The laundry machine according to claim 1, further comprising:

a water supply to supply water to the steam generator; and a water supply controller to control the supply of water to the steam generator.

3. The laundry machine according to claim 2, further comprising:

a tub to store washing water, wherein the drum is rotatably mounted within the tub.

4. The laundry machine according to claim 3, wherein the water supply supplies washing water to the tub, and the water supply controller controls the supply of the washing water.

5. The laundry machine according to claim 4, wherein the first steam supply part is in fluid communication with an interior of the tub at a predetermined position of the lower circumference of the tub, wherein the first steam supply part includes a first steam supply pipe.

6. The laundry machine according to claim 5, wherein the tub includes a storage part, protruding downward from a lower part of the tub, the storage part having a heater mounted therein to heat the washing water.

7. The laundry machine according to claim 6, wherein the predetermined position of the first steam supply part is lower than the bottom of the drum but is higher than the position where the heater is mounted.

8. The laundry machine according to claim 2 or 3, wherein the steam generator includes:

a case to store the water for steam generation, the case being located lower than the middle part of the machine body and in the machine body; and a heater to heat the water for steam generation.

9. The laundry machine according to claim 8, wherein the case is located substantially at a position lower than the bottom of the drum.

10. The laundry machine according to claim 8, further comprising:

a water level detection part to detect the water level of water received in the case.

11. The laundry machine according to claim 9, wherein the water supply includes:

a first water supply pipe to supply washing water to the tub; and a second water supply pipe to supply water to the case, and wherein the water supply controller includes water supply valves mounted on the first water supply pipe and the second water supply pipe, respectively.

12. The laundry machine according to claim 11, wherein the water supply valves and the heater are controlled based on the water level detected by the water level detection part.

13. The laundry machine according to claim 10, wherein the water level detection part includes an electrode sensor having at least two electrodes.

14. The laundry machine according to claim 3, further comprising: a washing water circulator to circulate washing water received in the tub; such that the washing water can be supplied into the drum.

15. The laundry machine according to claim 14, wherein the washing water circulator includes:

an inlet pipe to receive the washing water from the tub;

a circulating pump mounted on the inlet pipe to pump the washing water, and a guide pipe to supply the washing water pumped by the circulating pump into the drum.

16. The laundry machine according to claim 15, further comprising:

injection nozzles disposed at the end of the first steam supply parts and the end of the guide pipe to inject the steam and the washing water, wherein the injection nozzles extend through the tub such that the injection nozzles can communicate with the upper side of the drum.

* * * * *